United States Patent [19]

Macmillan et al.

[11] 4,238,679

[45] Dec. 9, 1980

[54] DUAL-CHAMBER IONIZATION SMOKE DETECTOR ASSEMBLY

[75] Inventors: John M. Macmillan, Deep River; Hilario S. Costa, Old Saybrook, both of Conn.

[73] Assignee: Conrac Corporation, Stamford, Conn.

[21] Appl. No.: 967,128

[22] Filed: Dec. 7, 1978

[51] Int. Cl.[3] ..... H01J 47/02

[52] U.S. Cl. ..... 250/385

[58] Field of Search ..... 250/381, 382, 384, 385; 340/579

[56] References Cited

U.S. PATENT DOCUMENTS

| | | | |
|---|---|---|---|
| 3,767,917 | 10/1973 | Lampart et al. | 250/384 |
| 3,838,283 | 9/1974 | Andersson | 250/389 |

*Primary Examiner*—Alfred E. Smith
*Assistant Examiner*—Janice A. Howell

[57] ABSTRACT

A housing assembly of interlocking parts for a dual-chamber ionization smoke detector in which the assembly has a single universal smoke detector head that can be readily twist-locked in one of a plurality of selectable adapter bases appropriate for a particular power source. The smoke detector head includes an interlocking assembly of an ionization chamber module protectively housed between an adapter base cover and a smoke detector cover. The detector head may be removed as a single subassembly from a particular adapter base, and additionally the detector head may be readily disassembled to remove the ionization chamber module for repair or replacement. The smoke detector cover has a dish-like configuration formed with an integral frusto-conical section. The interior of this section is formed with smoke deflector ribs. The cover protectively covers both the ionization smoke chamber and the adapter base.

The ionization chamber module includes an exterior field-effect transistor shield which not only attenuates stray fields but also enables the protective spray coating of the transistor to minimize false alarms.

10 Claims, 12 Drawing Figures

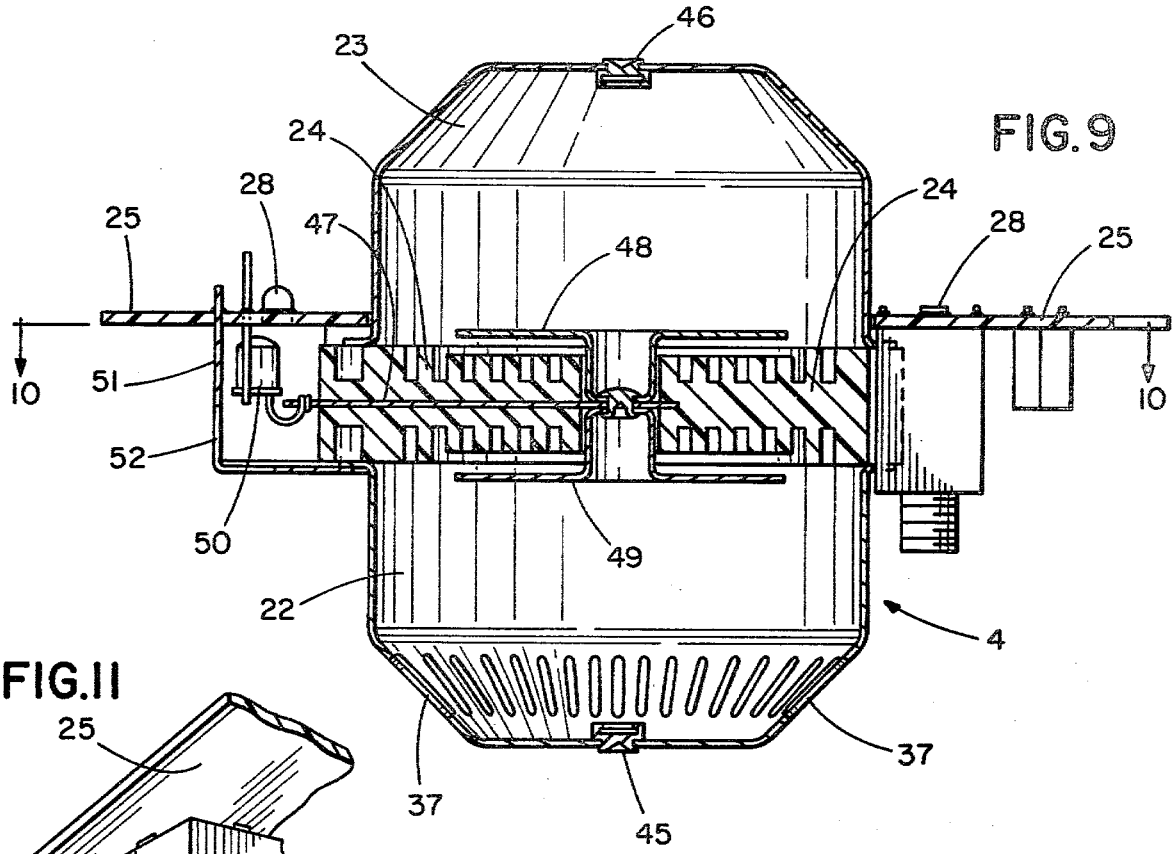
FIG. 9
FIG. 11
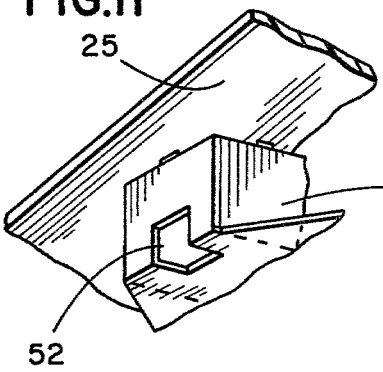
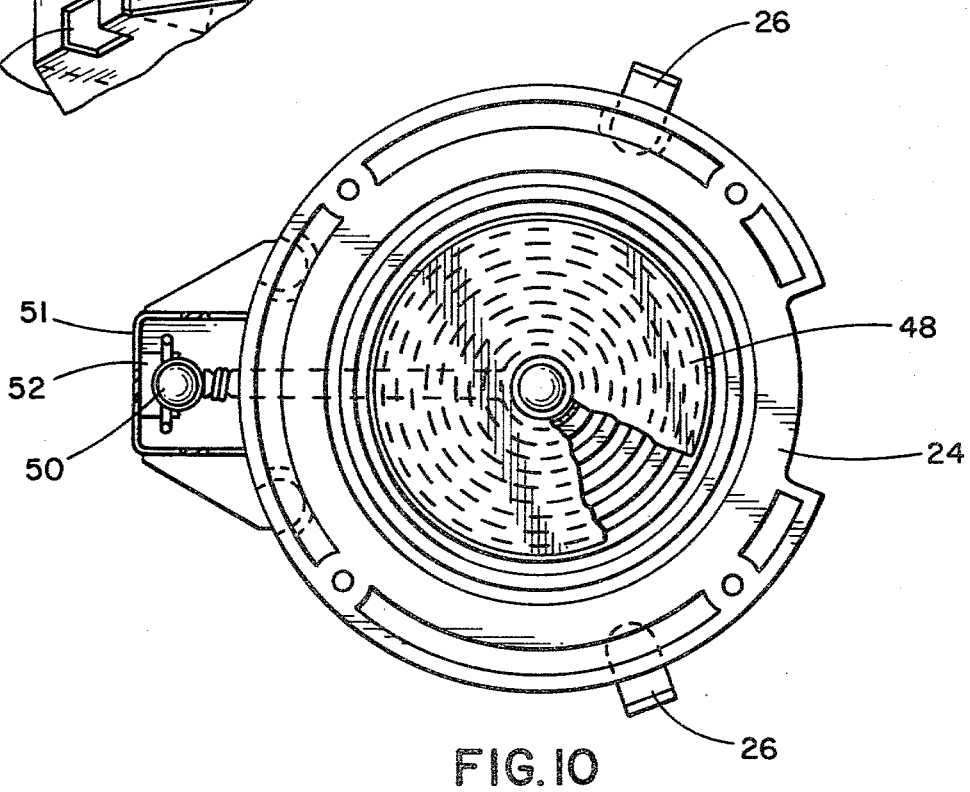
FIG. 10

DUAL-CHAMBER IONIZATION SMOKE DETECTOR ASSEMBLY

BACKGROUND OF THE INVENTION

Within recent years, smoke detectors both of the ionization and photoelectric types, have been recognized as highly advantageous life-saving devices for use in many varied kinds of installations.

These installations may include power sources which supply either alternating-current or direct-current voltages of different amplitudes.

The systems that employ such smoke detector may include optional auxiliary features, such as, central alarm indication of an activated smoke detector, auxiliary trouble circuits located in various parts of a building, and door control apparatus.

In the usual instance there is no defined detector location and mounting arrangement for such devices. In the main, detector location is determined by careful judgment based on engineering evaluations and field tests where possible.

Accordingly, it may be desirable to either flush-mount or surface-mount a particular smoke detector so as to take advantage of the optimum location available and also to provide an aesthetic application of the detector.

Additionally, in the case of an ionization-chamber smoke detector, a universal detector head may be used with a plurality of different detector bases, the detector bases being designed so that they can accommodate various voltages and auxiliary system configuration. With such an arrangement, only a single detector head need be designed and stocked.

SUMMARY OF THE INVENTION

Accordingly, a principal object of this invention is to provide a dual-chamber smoke detector assembly in which a universal smoke detector head may be employed with a plurality of adapter bases for different system applications as may be desired.

The smoke detector head and the adapter base are formed by an assembly of interlocking parts which house a dual-chamber ionization smoke detector. The assembly has a singly universal smoke detector head that can be readily twist-locked in one of a plurality of selectable adapter bases for a particular power source and also auxiliary system requirements.

A second principal object of the invention is to provide a smoke detector head which may be readily removed from an adapter base and at the same time the individual components of the detector head can be disassembled so that ready access may be had to the ionization chamber module.

In the main the foregoing object is attained by a smoke detector head design which includes an interlocking assembly of an ionization chamber module protectively housed between a cover for the adapter base and also the overall smoke detector cover. As previously noted, the detector head may be removed as a single assembly from the particular adapter base or alternatively, in order to accomplish the second objective, the detector head may be readily disassembled by first unscrewing the smoke detector cover and thereafter disengaging the ionization chamber module from catches formed on the adapter base cover.

Another principal object of this invention is to improve the channelling of smoke through the smoke access slots of an ionization smoke chamber.

The foregoing object is attained by a smoke detector cover design which has a dish-like configuration formed with an integral frusto-conical central portion. The frusto-conical portion is formed with smoke access slots and is designed to envelope protectively the smoke chamber. The inside of the cover is also formed with a pair of cross-ribs which serve as efficient deflector baffles for guiding an increased quantity of detected smoke into smoke access slots of the ionization chamber. The detection sensitivity of the smoke detector is thus enhanced.

Another principal object of the invention is to minimize the number of false alarms generated by ionization smoke detectors.

The foregoing object is attained by improving the shielding and the hermetic sealing of the commonplace input transistor used in high-input impedance, high-gain amplifiers used almost universally in ionization detector amplifiers. Due to the high-gain and high-impedance of the transistor input circuitry, false alarms are quite frequently generated by stray radio-frequency fields as swell as high static voltages which may accompany electrical storms, for example. Moreover, in high humidity environments moisture forms a leakage path across the terminals of the input transistor. This leakage path can in some instances cause false alarming of the smoke detector. The shield feature of this invention incorporates an opening by which an insulating plastic may be sprayed to hermetically seal and protect the transistor from humidity. Notwithstanding the opening, the shield is still effective to prevent false alarms due to static and radio-frequency fields.

DETAILED DESCRIPTION OF THE DRAWINGS

FIG. 9 is a section view of the ionization chamber module showing the interior of both dual chambers;

FIG. 10 is a section view taken along line 10—10 of FIG. 8 which shows an interior view of the FET housing shield;

FIG. 11 is a perspective view of FET housing shield; and

DETAILED DESCRIPTION OF THE PREFERRED EMBODIMENT

Figure 1:
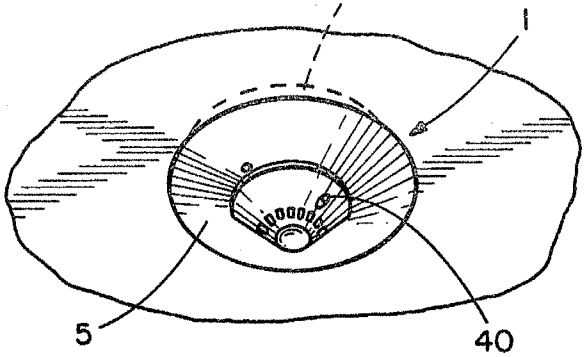
FIG. 1 is a perspective view of the smoke detector of this invention in a ceiling mounted application.
Figure 2:
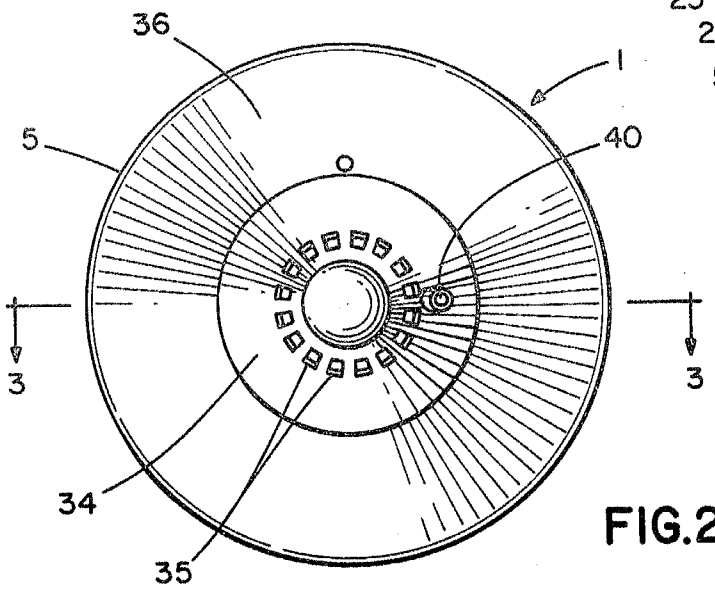
FIG. 2 is a plan view of the smoke detector of FIG. 1.

Referring now to the drawings, FIGS. 1 and 2 show smoke detector 1 of this invention in an open area ceiling-mounted detector application. The detector may be either surface or flush-mounted as is hereafter set forth in detail.

Figure 3:
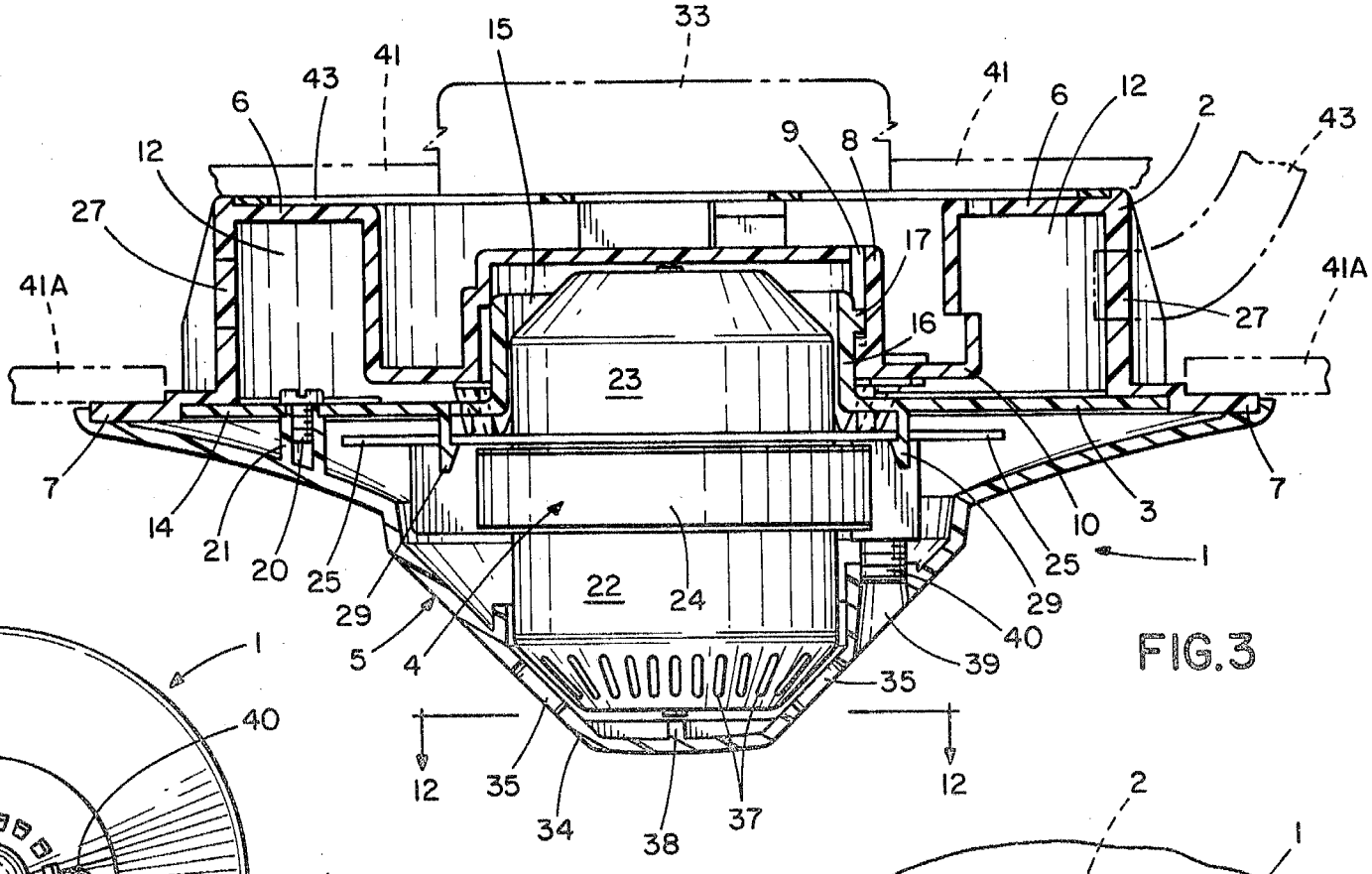
FIG. 3 is a modified section view taken along line 3—3 of FIG. 2 showing the assembled disposition of the principal components and subassemblies of the smoke detector.

The section view of FIG. 3 shows the engagement of the principal interlocking parts which comprise the detector assembly. The major components of this structure include adapter base 2 which may be fixedly mounted to a ceiling or other wall surface, adapter base cover 3 which protectively covers adapter base 2, and ionization detector module 4 which is partially inserted into subassembly 2,3 and which also partially projects from this subassembly, and a cover 5 which envelopes adapter base 2, base cover 3, and also ionization detector module 4.

Base cover 3, ionization detector module 4, and smoke detector cover 5 form a smoke-detector head subassembly of interlocking but separable parts which may be readily twist-locked into adapter base 2. Additionally, the smoke-detector head subassembly 3,4,5 may be readily disengaged from adapter base 2 by a reverse twist unlocking action.

Because the supply voltages which energize smoke detectors may vary from installation to installation from the commonplace 110 volt AC line voltage to 24 volts AC, and also 24 volts DC, the structural feature by which smoke-detector head subassembly 3,4,5 is readily removable enables the head to be interchangeable and usable with a different selection of bases to accommodate various voltages and system configurations.

Additionally, as is hereafter set forth, ionization chamber module 4 is readily removable from its protective assembled association with base cover 3 and smoke detector cover 5 by a disassembly of parts hereafter described. This structural housing feature enables the facile disengagement of smoke-detector head assembly 3,4,5 so that ionization chamber module 4 may be removed for inspection, repair or replacement as the case may be.

Figure 4:
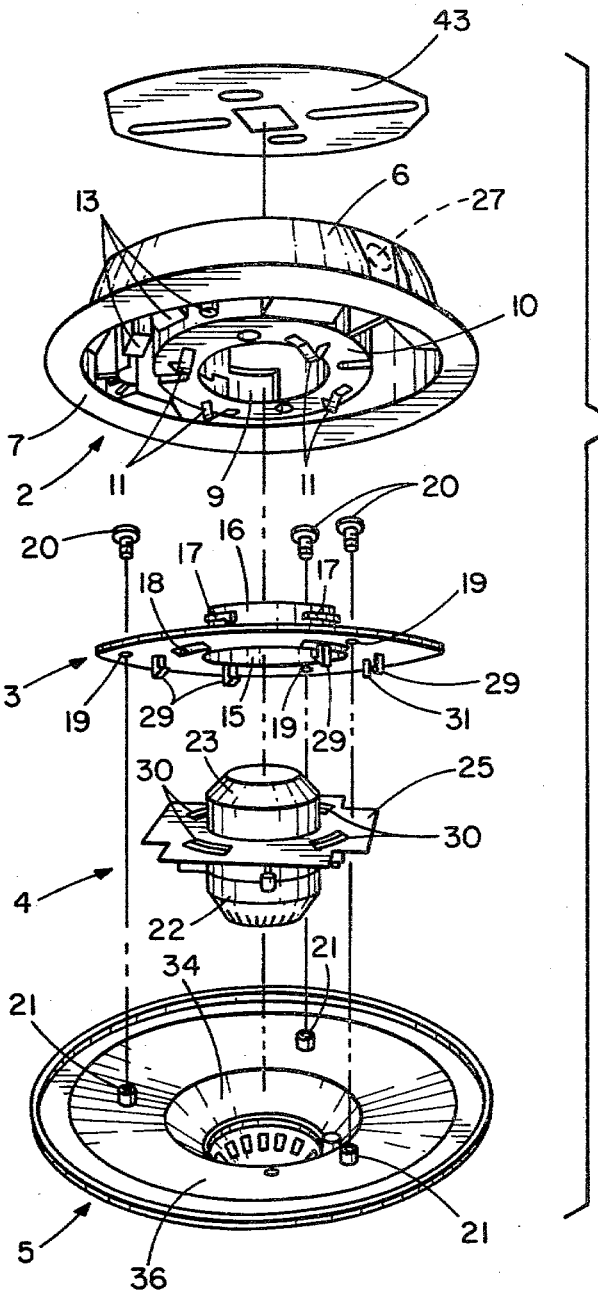
FIG. 4 is an exploded view of the principal components and subassemblies of the smoke detector.
Figure 8:
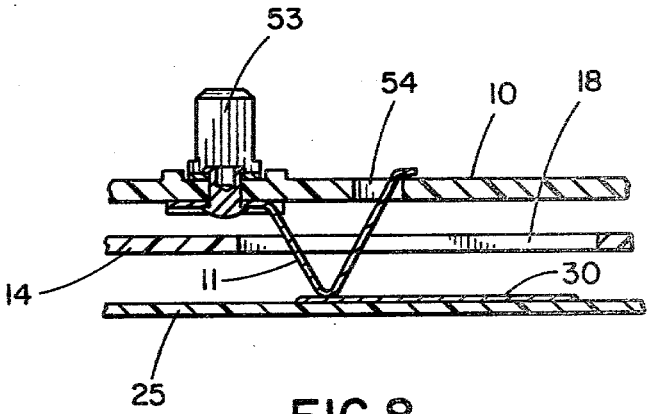
FIG. 8 is a section view showing the electrical connection formed by an adapter base brush contact with a contact of the ionization chamber module circuit board.
Figure 6:
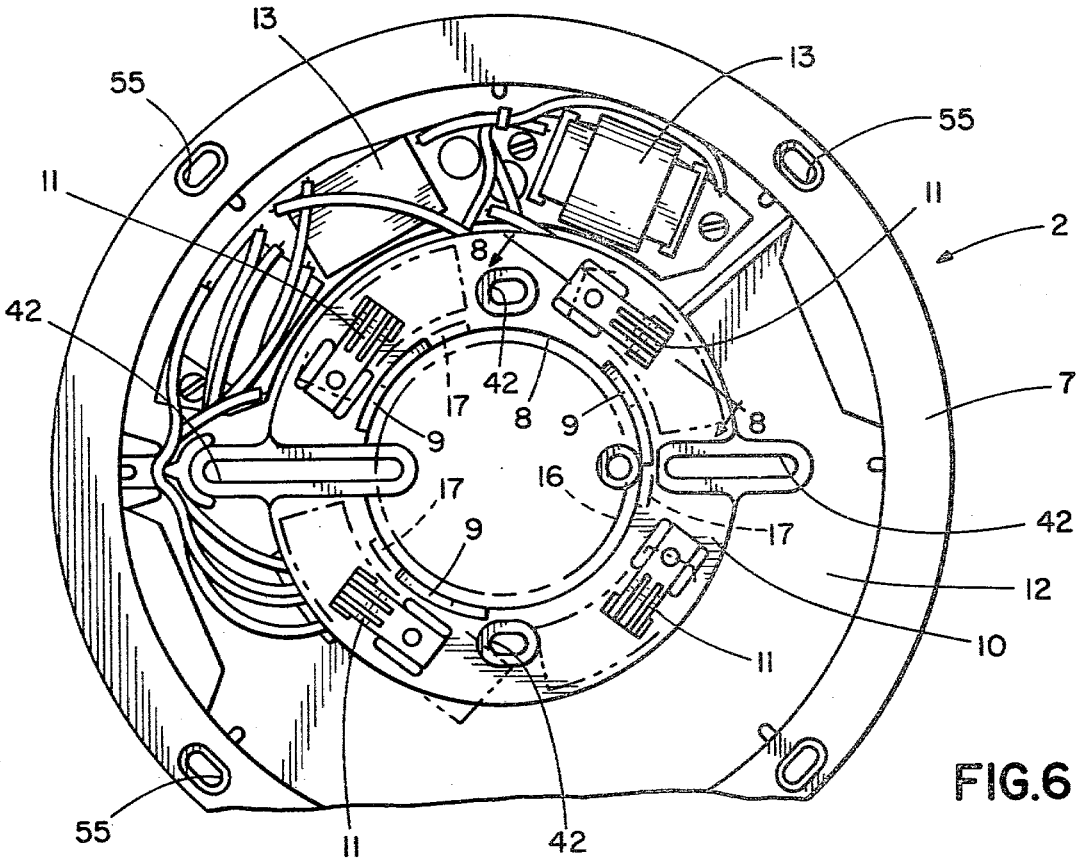
FIG. 6 is a plan view, related to FIG. 4, showing the interior of the adapter base with a typical disposition of housed components.

The structural details which enable the interlocking of principal components 2, 3, 4 and 5 into both subassemblies and also a complete smoke detector is shown in the exploded view of FIG. 4. In this Figure, adapter base 2 has a generally circular dish or panlike configuration which includes a base dish section 6 formed with an integral peripheral circular mounting flange 7. Adapter base 2 is also formed with a centrally disposed cylindrical socket section 8. The wall of socket 8 has a plurality of internal locking slots 9 (FIGS. 3,6). Cylindrical socket 8 is fixed to adapter base 2 by a circular, brush-contact support section 10. Brush-contact support section 10 carries a plurality of brush spring contacts 11 (FIG. 8). These contacts establish electrical circuit connection between components 13 housed within circular adapter base channel 12. These components 13 are shown in general outline in FIG. 6. In the main they include electrical relays and small transformers which are commonplace in smoke detector circuitry. These components will vary, however, depending upon the supply voltages available to energize the smoke detector and also system requirements.

Figure 5:
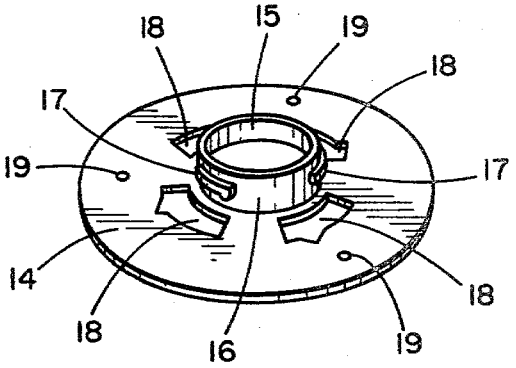
FIG. 5 is a perspective view, related to FIG. 4, showing the adapter base cover from a different angle.

Adapter base cover 3 (FIGS. 4,5) is formed with a circular disc-like body 14 having a central circular opening 15. Circular opening 15 is outlined by a projecting cylinder-like locking ring 16. Additionally, locking ring 16 is formed with a plurality of raised locking keys 17. Locking keys 17 mate with slots 9 of adapter base 2 when the adapter base cover 3 is bayonet inserted within the dish or panlike opening of the adapter base and twist locked into the adapter base. In particular, locking ring 16 is inserted within the socket 8 and twisted so that locking keys 17 engage locking slots 9.

Figure 7:
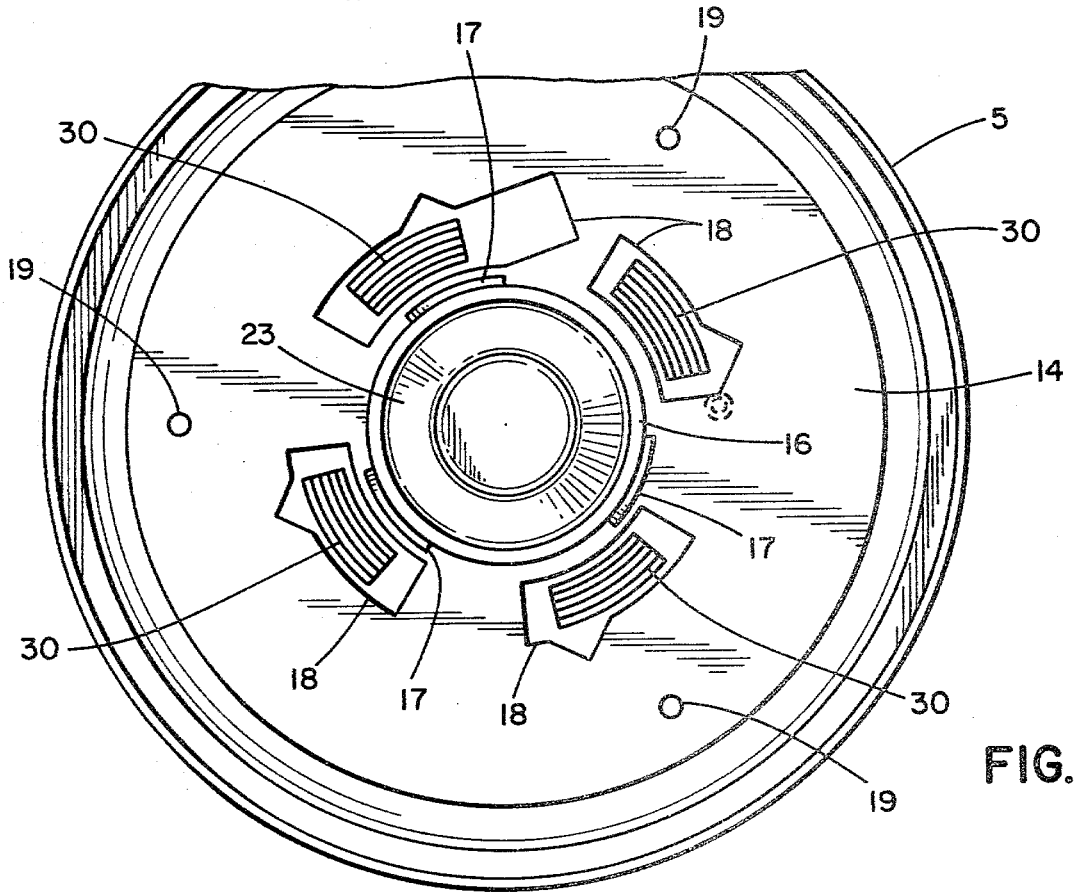
FIG. 7 is a bottom view of an ionization chamber module retained by and assembled between the smoke detector cover and the adapter base cover.

Base cover 3 (FIGS. 7,8) is also formed with a plurality of contact openings 18. These openings receive the several brush spring contacts 11 (FIG. 8) so that electrical contact can be made through base cover 3 to ionization chamber module 4 to effect the necessary circuitry connections.

Disc-like cover 14 is also formed with a plurality of screw holes 19 which receive a plurality of screws 20 so that the base cover 3 can be fastened to threaded bosses 21 of smoke detector cover 5 by screws 20.

Ionization chamber module 4 includes a dual-chamber ionization detector having a smoke chamber 22 and a compensating chamber 23 (FIG. 9). The two chambers 22 and 23 are isolated from one another by insulator mounting block 24. A circuit board 25 which is generally square and having notched corners is staked to the dual ionization chamber 22, 23 by means of mounting lugs 26 (FIG. 10). Circuit board 25 supports a plurality of electrical components 28 which comprise the high-gain amplifier circuitry (not shown) connected to the output of the dual-chamber ionization detector.

The surface of disc 14 of base cover 3 opposite locking ring 6 supports a plurality of detector module catches 29 (FIGS. 3,4). Catches 29 are formed with hooked ends which provide a camming surface which moves away catches 29 in response to the forced engagement of circuit board 25 to adapter base cover 3. When ionization chamber module 4 and adapter base cover 3 are engaged, as is shown in FIG. 3, compensating chamber 23 is protectively housed within locking ring 16 and contacts 30 formed on the surface of printed circuit board 25 (FIG. 8) are aligned with contact openings 18 (FIG. 7) so all spring contacts 11 make electrical connection between components 13 housed within adapter base 2 and ionization chamber module 4. Each contact spring 11 is fixed to contact support section 10 by riveted terminal 53. Support section 10 is formed with a spring receiving hole 54 which permits the flexing of the associated spring contact 11.

Adapter base cover 3 is formed with an alignment post 31 which engages alignment post hole 32 formed in printed circuit board 25 so that the ionization chamber module is appropriately aligned in the adapter base cover.

After adapter base cover 3 and ionization detector module 4 are assembled, smoke detector cover 5 is engaged to the subassembly 3,4 by tightening screws 20 on threaded bosses 21. With this screw tightening operation, the subassembly of components 3,4,5 form a unitary interlocked smoke detector head which may be twist-locked to adapter base 2, and also reversibly unlocked from adapter base 2 as is required. Accordingly, a single smoke detector head 3,4,5 may be interchangeably applied to different adapter bases 2 designed for different power supply voltages or different system requirements. The necessary electric contact connections are made in all instances between the several brush spring contacts 11 and printed circuit contacts 30 through the contact openings 18 in adapter base cover 3.

Figure 12:
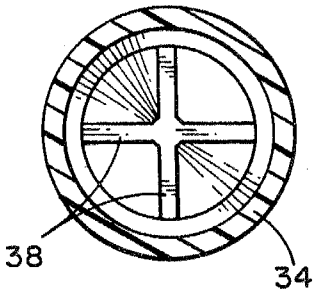
FIG. 12 is a section view taken along line 12—12 of FIG. 3 which shows the disposition of the internal smoke baffles located on the housing cover.

Smoke detector cover 5 protectively houses smoke chamber 22 and also protectively covers adapter base 2 and its adapter base cover 3. Cover 5 is formed with a general frusto-conical central portion 34 which is formed with a plurality of smoke access slots 35. Frusto-conical central portion 34 is integral with a peripheral dish-like cover portion 36. The joining together of the cover portions 34 and 36 in the manner shown provides an aesthetic and protective cover for the rest of the smoke assembly and at the same time provides access through cover slots 35 to slots 37 of smoke chamber 22. The series of slots 35 and 37 are not necessarily aligned so that a tortuous path is generally followed by smoke passing into smoke chamber 22. Additionally, as is shown in FIGS. 3 and 12, the inside apex portion of frusto-conical section 34 is formed with a pair of projecting cross ribs 38 which act as a deflector baffle to guide smoke more efficiently into the smoke access slots 37 of smoke chamber 22.

Cover 5 is also formed with a jack opening 39 through which access to test jack 40 is provided. This test jack operates in association with auxiliary test equipment (not shown) so that the operational functioning of smoke detector 1 may be tested as is required.

As has been previously set forth, smoke detector 1 may be either surface or flush-mounted on any ceiling or wall. The surface disposition of smoke detector 1 is shown in FIG. 3. In particular, receptacle box 33 is ceiling mounted with access to smoke detector 1 being provided through an opening formed in ceiling 41. In such an application, mounting screws (not shown) are passed through receptacle mounting slots 42 (FIG. 6) which engage conventional mounting flanges formed as part of receptacle box 33. In order to prevent dust and other foreign material, commonplace in building walls from entering adapter base 2 and possibly adversely affecting the operation of the electrical circuit components contained within channel 12 of this base, an optional plastic receptacle box dust cover 43 (FIG. 4) is preferably located over the receptacle box so that the dust cover isolates the internal chambers of adapter base 2 from the receptacle box.

As an alternative mounting arrangement, flange 7 of adapter base 2 enables smoke detector 1 to be flush-mounted on ceiling 41A. With such an application, adapter base 2 is isolated behind ceiling 41A and as such is not visible to a room occupant. Receptacle box 33 is located above ceiling 41A when compared with the alternative ceiling mounted disposition with respect to ceiling 41. Electrical connection to smoke detector 1 is provided by a conduit 44 which couples adapter base 2 at conduit knockout 27 formed in the exterior wall of the adapter base. Adapter base 7 is fastened to ceiling 41A by screws (not shown) passing through the set of flush mounting holes 55 located in mounting flange 7 (FIG. 6).

Ionization chamber module 4 includes a more or less conventional dual ionization chamber 22 and 23 having dual ionization sources 45 and 46. The chambers are isolated by plastic mounting block 24, and electrical connection is effected to both chambers by means of embedded terminal 47 which is connected to collector plates 48 and 49. The ionization chamber output signal appears on terminal 47 and is applied to FET transistor 50. Inasmuch as FET transistor 50 is a conventional MOS semiconductor device connected in a high-gain, high-impedance amplifier input configuration, it is readily susceptible to spurious radio-frequency signal and static and other random high voltage charges which will cause false alarming of smoke detector 1. Likewise, excessive humidity buildup on the FET transistor will cause input impedance variations which will simulate a false smoke condition.

Accordingly, a metal box-like shield housing 51 envelopes FET transistor 50. Shield housing 51 is formed with an access opening 52 so that a spray plastic may be applied to protectively encapsulate transistor 50 as is required. Access to the field effect transistor may be had only through opening 52 and inasmuch as the remaining sides are isolated by circuit board 25, the adjacent portions of chambers 22 and 23 and mounting block 25, are highly protected and an effective shielding arrangement for field effect transistor 50 is provided. Shield flanges 56 support shield housing 51 relative smoke chamber 22.

It should be understood that the above described arrangements are illustrative of the principles of this invention, and that changes can be made in the precise structure shown.

What is claimed is:

1. A dual-chamber ionization smoke detector, having a housing structure formed with at least four readily separable parts protectively housing a generally cylindrical dual ionization chamber and other electrical components comprising:

an adapter base having a generally circular panlike configuration formed with an integral peripheral circular flange, having a centrally disposed cylindrical socket formed with a wall having internal locking slots to define a twist-lock smoke detector head socket, and having a plurality of brush contacts carried by the socket wall;

a circular disc-like adapter base cover formed with a central circular opening and a plurality of contact openings disposed about the circular opening, having a projecting cylinder-like locking ring emanating from the circular opening and carrying a plurality of raised locking keys which mate with the internal locking slots when the adapter base cover is disposed within the panlike opening of the adapter base and twist-locked into the adapter base socket, and having a plurality of ionization chamber module catches;

an ionization chamber module including a relatively flat circuit board having a plurality of circuit board contacts and formed with a central opening, and a dual-chamber ionization detector with both chamber sections being rigidly fixed one to the other and with the ionization detector being centrally disposed within the circuit board opening with one section of the chamber being housed within the locking ring and the circuit board being held on the adapter base cover by the detector module catches; and a smoke detector cover having a generally frusto-conical central portion formed with smoke access slots and with a peripheral dish-like portion with the cover enveloping the second or smoke section of the chamber and the covered adapter base, the cover including means for being fixed to the adapter base, whereby a twisting action removes or alternatively fixes from or to the adapter base an assembled smoke detector cover, ionization chamber module and adapter base cover.

2. The combination of claim 1 in which the interior of the frusto-conical central portion of the smoke detector cover is formed with one or more raised ribs which acts as a deflector baffle to effectively guide smoke into the smoke section of the chamber which is formed with access slots.

3. The combination of claim 2 in which the ribs are crossed.

4. The combination of claim 1 including a semiconductor element supported on the exterior of the dual-chamber ionization detector, and a box-like metallic shield having an access opening enveloping the semiconductor element and attached to the exterior of the ionization detector.

5. The combination of claim 2 including a semiconductor element supported on the exterior of the dual-chamber ionization detector, and a box-like metallic shield having an access opening enveloping the semiconductor element and attached to the exterior of the ionization detector.

6. A dual-chamber ionization smoke detector, having a housing structure formed with at least four readily separable parts protectively housing a dual ionization chamber and other electrical components comprising:

an adapter base having a generally circular configuration formed with an integral peripheral circular flange, having a centrally disposed socket having a first set of locking elements to define a smoke detector head locking socket, and having a plurality of contacts carried by the socket;

a disc-like adapter base cover formed with a central opening and a plurality of contact openings disposed about the circular opening, having a projecting locking ring emanating from the central opening and carrying a second set of locking elements which mate with the first set of locking elements when the adapter base cover is disposed on the adapter base and locked into the adapter base socket, and attachment means for an ionization chamber module;

an ionization chamber module including a relatively flat circuit board having a plurality of circuit board contacts and formed with a central opening, and a dual-chamber ionization detector with both chamber sections being rigidly fixed one to the other and with the ionization detector being centrally disposed within the circuit board opening with one section of the chamber being housed within the locking ring and the circuit board being held on the adapter cover by the attachment means; and a smoke detector cover having a central portion formed with smoke access slots and with a peripheral dishlike portion with the cover enveloping the second or smoke section of the chamber and the covered adapter base with the cover including means for being fixed to the adapter base, whereby a twisting action removes or alternatively fixes from or to the adapter base a smoke detector head including an assembled smoke detector cover, ionization chamber module and adapter base cover.

7. The combination of claim 6 in which the interior of the frusto-conical central portion of the smoke detector cover is formed with one or more raised ribs which acts as a deflector baffle to effectively guide smoke into the smoke section of the chamber which is formed with access slots.

8. The combination of claim 7 in which the ribs are crossed.

9. The combination of claim 6 including a semiconductor element supported on the exterior of the dual-chamber ionization detector, and a box-like metallic shield having an access opening enveloping the semiconductor element and attached to the exterior of the ionization detector.

10. The combination of claim 7 including a semiconductor element supported on the exterior of the dual-chamber ionization detector, and a box-like metallic shield having an access opening enveloping the semiconductor element and attached to the exterior of the ionization detector.

* * * * *